US005574793A

United States Patent [19]

Hirschhorn

[11] Patent Number: 5,574,793

[45] **Date of Patent: *Nov. 12, 1996**

[54] AUTOMATED CONFERENCE SYSTEM

[76] Inventor: Bruce D. Hirschhorn, 156 Farber Hill Rd., Boonton, N.J. 07005

[ * ] Notice: The term of this patent shall not extend beyond the expiration date of Pat. No. 5,406,638.

[21] Appl. No.: 410,832

[22] Filed: Mar. 27, 1995

Related U.S. Application Data

[63] Continuation of Ser. No. 981,593, Nov. 25, 1992, Pat. No. 5,406,638.

[51] Int. Cl.[6] ..... H04R 25/00

[52] U.S. Cl. ..... 381/169; 381/152; 379/202

[58] Field of Search ..... 381/168, 169, 381/26, 205, 152, 86; 379/202, 206; 248/333

[56] References Cited

U.S. PATENT DOCUMENTS 2,288,822 7/1942 McCarron ..... 381/169

FOREIGN PATENT DOCUMENTS 4017554 12/1991 Germany ..... 381/169

*Primary Examiner*—Curtis Kuntz
*Assistant Examiner*—Huyen D. Le
*Attorney, Agent, or Firm*—Michael J. Weins

[57] ABSTRACT

The present invention is for a conference system that provides microphones that are ceiling mounted and retract into the ceiling when not in use. The system has microphones that mount on wands with the wand and microphone forming a unit which is stored above the ceiling when not in use. In a preferred embodiment, the wand is connected to an automobile power antenna which is energized to raise and lower the antenna. The system is preferably activated by a proximity sensor, located in the cradle of a phone that senses the presence of a phone hand piece and activates the system when the phone hand piece is removed from the cradle.

3 Claims, 5 Drawing Sheets

AUTOMATED CONFERENCE SYSTEM

This is a continuation of application Ser. No. 07/981,593 filed on Nov. 25, 1992 now U.S. Pat. No. 5,406,638.

FIELD OF INVENTION

The present invention relates to a conference system and, more particularly, a system with a concealable, positionable microphone which can be activated by lifting a phone.

BACKGROUND OF THE INVENTION

There have been a variety of conference, teleconference, and sound recording systems which provide for audio pick-up from various locations. Microphones have been mounted on booms which can be swung from position to position keeping the microphone in close proximity to the sound source, assuring audio pick-up.

More recently, multiple microphone systems have been employed by the performing arts and for conferences. The microphones for these systems are frequently suspended or hung from the ceiling. These microphones use a switching system, which can be mechanically activated to assure that the appropriate microphone is activated and maintains a balance of the system's microphones. Alternatively, in the conference situation, the microphones can be activated by the party who wishes to speak. These systems that use multiple microphones eliminate the need for lateral movement of the microphones and the use of booms.

However, current systems with multiple hanging microphones frequently have exposed cables which detract from the decor and leave in place unwanted microphones when the system is not in use.

Thus, there is a need for a conference system that will provide positionable microphones which are unobtrusive when in use and can be readily concealed when the system is not being used.

SUMMARY OF INVENTION

It is an object of the invention to provide a ceiling mounted microphone system which has microphones that are unobtrusive when in use.

It is another object of the invention to provide microphones for a conference room that are stored in the ceiling when the system is not in use.

It is a further object of the invention to provide storage of the microphones above the ceiling where the clearance between the ceiling and a roof or floor substructure is limited.

It is still a further object of the invention to provide a conference and teleconference system which is activated by removal of the handpiece of a phone from its cradle.

It is yet another object of the invention to provide a conference and telecommunication system which will be deactivated by placing the hand piece of a phone in it's cradle, in the phone base of a phone, and will raise the microphones into the ceiling for concealment.

These and other objects of the invention become obvious from the following description, drawings and claims.

The present invention provides an improved conference system which, when not in use, has microphone units which can be readily concealed behind a ceiling. Each of the microphone units for the conference system has, in its simplest form, a guide having a central passage and means for securing the guide with respect to the ceiling. A wand, having a first end and a second end, slidably engages the central passage of the guide. A microphone is attached to the first end of the wand. Means are provided for raising and lowering the wand which is attached to the second end of the wand. In a preferred embodiment, the system has a proximity switch in the cradle of a phone and senses the proximity of the hand held unit. The proximity switch activates the control system for lowering the microphone units and readying them for use.

A preferred means for raising and lowering the wands is a telescoping extender made from concentric tubes. Any one of a number of commercially available power telescoping antennas, such as currently used on automobiles, can be employed for this function. When a power telescoping antenna is employed, the tip of the antenna is attached to the second end of the wand. While power telescoping antenna units are commercially available and will readily serve as means for raising and lowering the wand, one skilled in the art could readily develop alternate means of providing a telescoping extension made from concentric tubes.

If antennas are used, it is desired to limit the transverse of the antenna to less than its full range of extension. A positionable stop for limiting the motion of the antenna is attached to one of the telescoping sleeves of the antenna. By the appropriate placement of the positional stop, it will limit the retraction of the antenna thereby limiting the motion of the wand.

It is further preferred that the wand as well as the surface of the central passage of the guide be acrylic. Acrylic surfaces serve as self lubricating surfaces and will limit marring or scarring of the wand's surface as it slides in the central passage of the guide.

When the clearance between the ceiling and a floor or roof above the ceiling is limited, it is further preferred that a means for rotating the guide be provided such that the wand is tilted for storage at an angle $\alpha$ with respect to the horizontal.

When the wand tilts and a rigid structure, such as an antenna, is used to raise and lower the wand, it is further preferred that a flexible coupling between the wand and the antenna be employed.

It is further preferred that means be provided to assure that the antennas are fully extended before the wands are rotated to the vertical position. This will assure that the flexible coupling has a natural breakpoint between the antenna and the lowered wand.

When multiple microphone units are employed, it is preferred that the raising and lowering of the microphones be synchronized and activated through a common switch. When the wands and microphones are tilted for storing, means are provided for sequentially extending and rotating the wands and limiting the rotation to those wands which are fully extended. This will assure that the flexible coupling is properly positioned to avoid torsional loads on the antennas. Preferably, means for sensing motion and extension of each of the wands is provided to assure that all wands are stationary before rotation.

BEST MODE OF CARRYING THE INVENTION INTO PRACTICE

Figure 1:
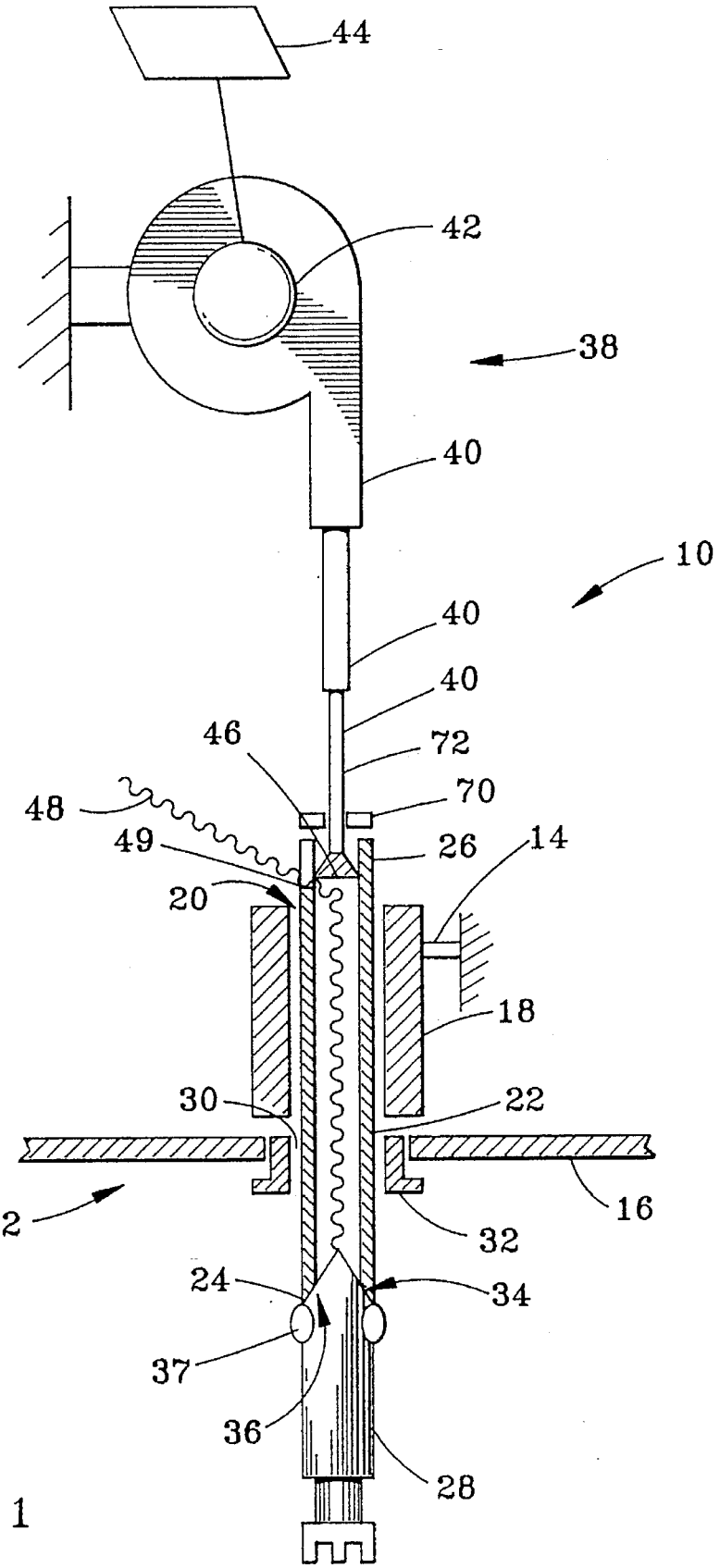
FIG. 1 shows a microphone unit of the improved system of the present invention. The microphone units have a wand microphone element which is vertically stored above the ceiling. A power telescoping antenna unit is employed for raising and lowering the microphone.

FIG. 1 illustrates a microphone unit 10 for the improved conference system of the present invention. The microphone unit 10 is mounted behind a ceiling 12. The microphone unit 10, as shown in FIG. 1, has a bracket 14 which is located behind the exposed surface 16 of the ceiling 12. A guide 18, having a central passage 20, is connected to the mounting bracket 14 which serves as means for securing the guide with respect to the ceiling. It should be appreciated that the guide could be extended into the ceiling and attached thereto in which case the ceiling would serve as a means for securing the guide.

A wand 22 is provided which has a first end 24 and a second end 26. The wand 22 is sized so that it will slidably engage the central passage 20 of the guide 18. A microphone 28 is attached to the first end 24 of the of the wand 22. It is preferred that the microphone 28 and the wand 22 have the same cross section. Having the microphone 28 and the wand 22 so configured allows openings 30 in the ceiling 12 to have a cross section of both the wand 22 and the microphone 28 minimizing the gap between the microphone 28 and the wand 22. Microphones with a diameter of less than about ½" are readily available and, when microphones of this size are employed, the openings 30 in the ceiling 12 may not be readily perceivable to those in the room. This is particularly true when the ceiling is fabricated from acoustical tiles which have a pattern of holes therein to enhance their sound dampening capacity. In the event that the openings 30 are apparent, a more finished appearance can be maintained by using inset rings 32.

It is further preferred that the first end 24 have a tapered opening 34 which is contoured to mate with a tapered end 36 of the microphone 28. A filler ring 37 is employed around the microphone 28 to provide a smooth transition between the wand 22 and the microphone 28.

Means are provided for raising and lowering the wand 22. A preferred means for raising and lowering the wand 22 is a power antenna 38. The antenna is fabricated from a series of telescoping concentric elements 40. A number of models are commercially available such as the power antennas offered by Harada. A motor 42 drives telescoping concentric elements 40 from a retracted position where the concentric elements 40 are superimposed on each other to an extended position where the telescoping concentric elements 40 are in an end to end relationship. The motor 42 can be engaged and disengaged from the antenna 38 with a clutch. Toggle switches, magnetic proximity switches, or their equivalent can be employed to disconnect the motor 42 from a power source 44 and to reverse the direction of the rotation of the motor 42 thereby reversing the direction of the motion of the antenna 38. One such arrangement is found in the Harada model MX22 antenna.

Alternatively, electronic switching circuits can be employed to control power to the motor and the motor direction of rotation. The electronic switching circuits are activated by current sensing devices which are triggered when the current demand of the motor spikes. The Harada model MT4 antenna works on this principal.

The clutch controlled or current sensing controlled motors, such as discussed above, are commonly used for automotive power antennas. The controls for the motor assures that automobile antennas automatically raise when the radio is played and lower when turned off. These power antennas also protect the motor in the event that an antenna section is bent and will not collapse. These power antennas allow the motor to stop without damage when the antenna will no longer collapse; and yet, they permit the collapsed section of the bent antenna to be again extended when the radio is turned on.

When telescoping concentric elements 40 are employed, it is preferred that the telescoping concentric elements 40 have a tip 46 that is attached to the second end 26 of the wand 22. A cord 48 for the microphone 28 is carried in the wand 22. It exits the wand 22 through a notch 49 located in the vicinity of the second end 26 of the wand 22.

While there are a variety of commercially available power antennas which can be used in the present invention, it should be appreciated that one skilled in the art could readily develop alternate means for raising and lowering the wand 22.

Figure 2:
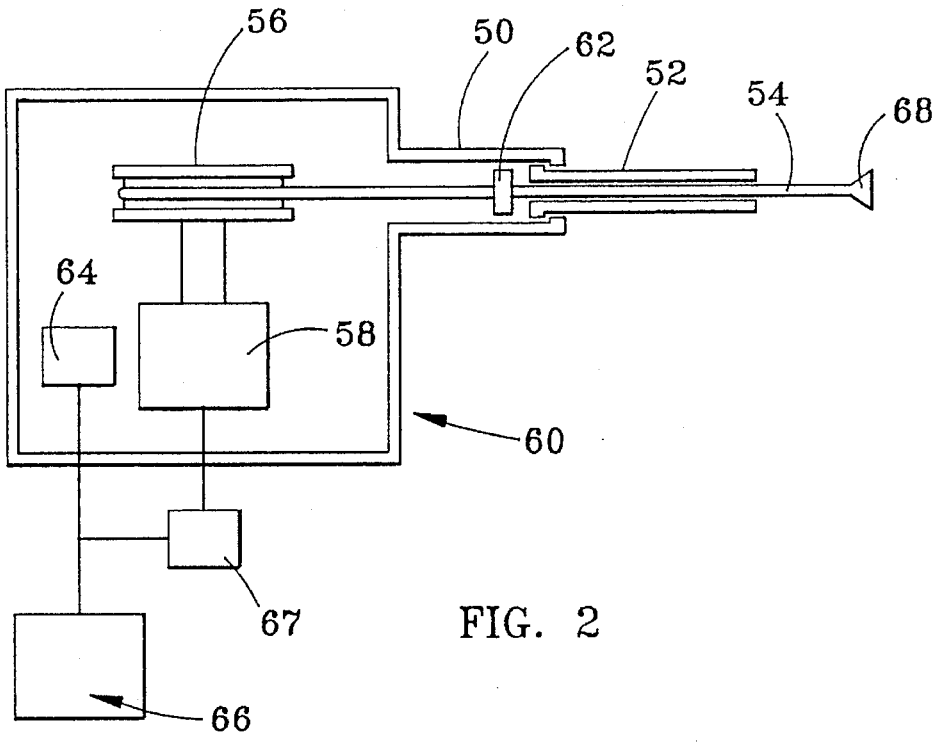
FIG. 2 is a schematic representation of an alternative means for raising and lowering the microphone, employing telescoping extenders which are concentric tubes.

FIG. 2 illustrates one alternate unit for raising and lowering the wand. This unit has a first sleeve 50 that is concentric with and slidably engages a second sleeve 52. The second sleeve 52 is, in turn, aligned with a flexible wire 54 which passes through both the first sleeve 50 and the second sleeve 52. The flexible wire 54 is attached to a spool 56 and is advanced and retracted by winding and unwinding the flexible wire 54 onto the spool 56. The cooperative movement between the first sleeve 50, the second sleeve 52, and the flexible wire 54 provides for extension and collapse of the concentric sleeves 50, 52, and the flexible wire 54. The spool 56 is, in turn, driven by a motor 58 which mounts on a frame 60 to which the first sleeve 50 is attached. When the motor 58 is energized and rotating such that the flexible wire 54 is unwinding, the flexible wire 54 will advance until a stop 62, attached to the flexible wire 54, engages the second sleeve 52, and the second sleeve 52 has reached its full extension. When this condition is met, the torque requirement of the motor 58 will increase, and the current drawn by the motor 58 will surge. A current sensor 64, responsive to the surge in current, will break connection with a power source 66 stopping the motor 58. At the same time, the current sensor 64 will provide a signal to the circuit 67 which will reverse the response of the motor 58 power source 66. Thus, when the motor 58 is again energized, the motor 58 will rotate in the opposite direction and retract the flexible wire 54. During the next cycle, as the flexible wire 54 retracts, it is drawn into the second sleeve 52 and continues to be drawn in until an end cap 68 engages the first sleeve 50. When the end cap 68 engages the first sleeve 50, the torque on the motor 58 will increase causing the current to surge and the current sensor 64 will again break the circuit with the power source, stopping the motor 58 and sending a signal to the circuit 67, reversing the response of the motor to the power source 66.

Referring again to FIG. 1, it is preferred that there be a positionable stop 70 provided which engages the first section 72 of the antenna 38. The positionable stop 70 is placed at a location on the antenna 40 such that the microphone 28 can be raised above the ceiling 12 but the wand 22 cannot pass through the guide 18.

It is further preferred that the central passage 20 of the guide 18 and the wand 22 have acrylic surfaces. Acrylic surfaces are self lubricating and the sliding of one over the other avoids marring of the wand 22 when sliding in the guide 18.

When the clearance between the ceiling and the floor or the roof above is limited, it is further preferred that a means for tilting the guide 18 be provided, thereby tilting the wand 22. Storing the wand 22 in a tilted position reduces the clearance needed between the ceiling and the structure above.

Figure 3:
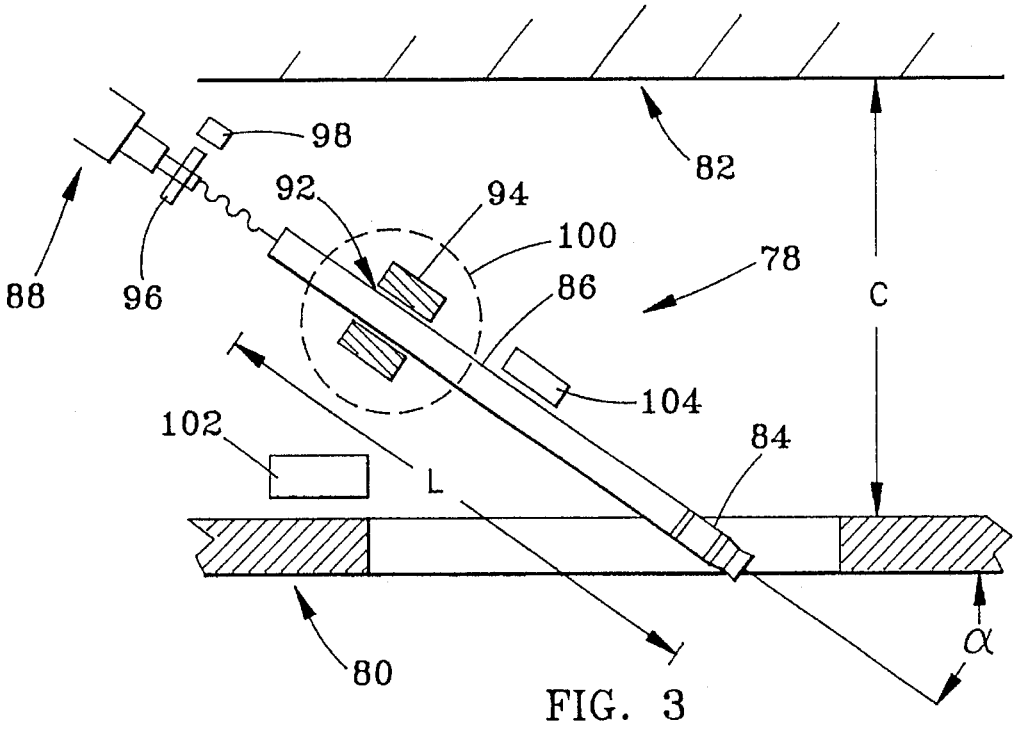
FIG. 3 illustrates another embodiment of the improved system of the present invention where the wand microphone element tilts for storing, thereby reducing the clearance needed between the ceiling and the floor or roof above.

FIG. 3 illustrates a wand and microphone element 78 which tilts to permit storage of the wand and microphone unit 78 above the ceiling 80. With the wand and microphone unit 78 tilted at an angle α, the clearance C between the floor or the roof 82 and the ceiling 80 may be less than the length L of the wand and microphone unit 78.

The wand and microphone unit 78 having a microphone 84 and a wand 86 which are axially aligned, is tilted for storage at an angle α with respect to the horizontal. For this embodiment, the means for securing the guide relative to the ceiling must be a bracket which is not an integral part of the ceiling such as the bracket 14 shown in FIG. 1. When so tilted, an antenna 88 is provided to extend and retract the wand 86. The antenna 88 is also tilted at an angle α so that it is axially aligned with the wand 86, when the wand 86 is tilted. As the antenna 88 is extended, the wand 86 slides through the central passage 92 of the guide 94 advancing the wand 86 and extending the microphone 84 beyond the ceiling 80. When the wand 86 is fully extended, a stop 96 will trigger a sensing means 98 and activate a pivoting means 100 which rotates the guide 94. A magnetic proximity switch is the preferred sensing means 98 in which case, the stop 96 is a magnet. This stop 96 can also function as the positionable stop 70 of FIG. 1.

A motor and gear train interposed between a bracket and the guide 94 serves as the pivoting means 100 which rotates the guide 94. When energized, the motor and the gear train 100 will rotate the wand 86 to a vertical position, shown in FIG. 4. A first wand magnetic proximity switch 102 is provided which stops the motor and gear train 100 changing the polarity of the motor so that when it is next activated, the wand 86 will be rotated so that it will be tilted again at an angle α with respect to the ceiling 80 and positioned for raising. A second magnetic proximity switch 104 is provided which limits the rotation of the wand 86 to the angle α and reverses the polarity of motor so that, during its next cycle, the wand 86 will again be rotated to a vertical position.

It should be appreciated that the magnetic proximity switches 102 and 104 need not be employed when a servo unit, rather than a motor and gear train 100, is employed. The indexing can be included in the servo circuitry.

Figure 4:
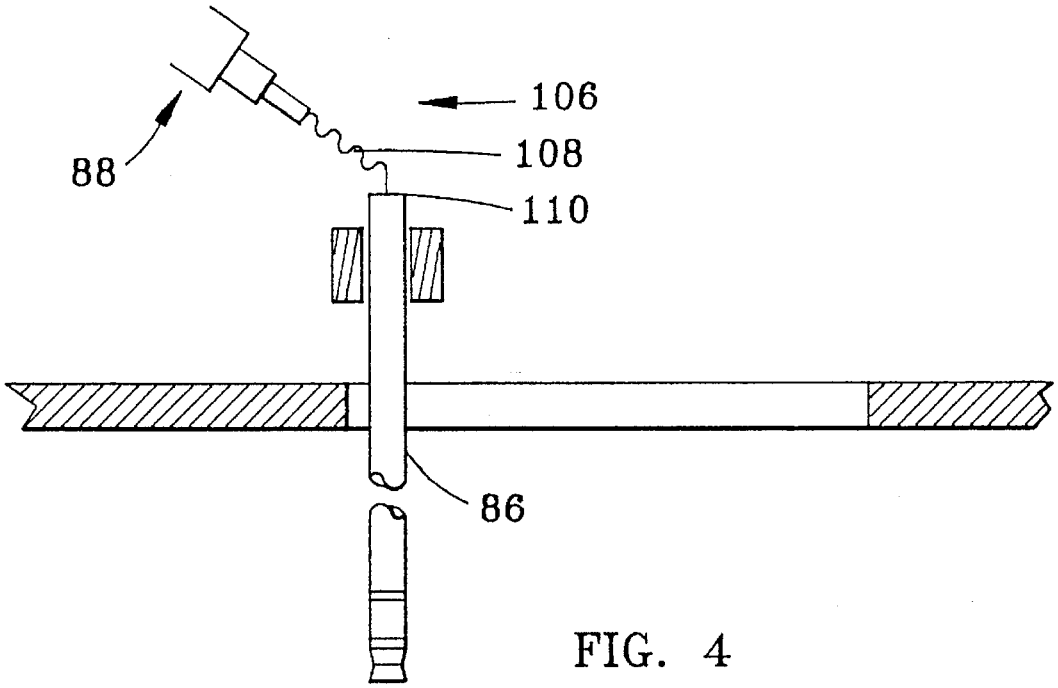
FIG. 4 illustrates a coupling element for attaching an antenna and a tiltable wand microphone unit. In this embodiment, a spring provides a flexible coupling between the antenna and the wand. The flexible coupling allows the wand to be rotated without placing a torsional load on the antenna.

To accommodate the rotation of the wand 86 with respect to the antenna 88, a flexible coupling 106, such as a spring 108, is employed. The spring 108 attaches to an antenna 88 and to the second end 110 of the wand 86 as is shown in FIG. 4.

Figure 5:
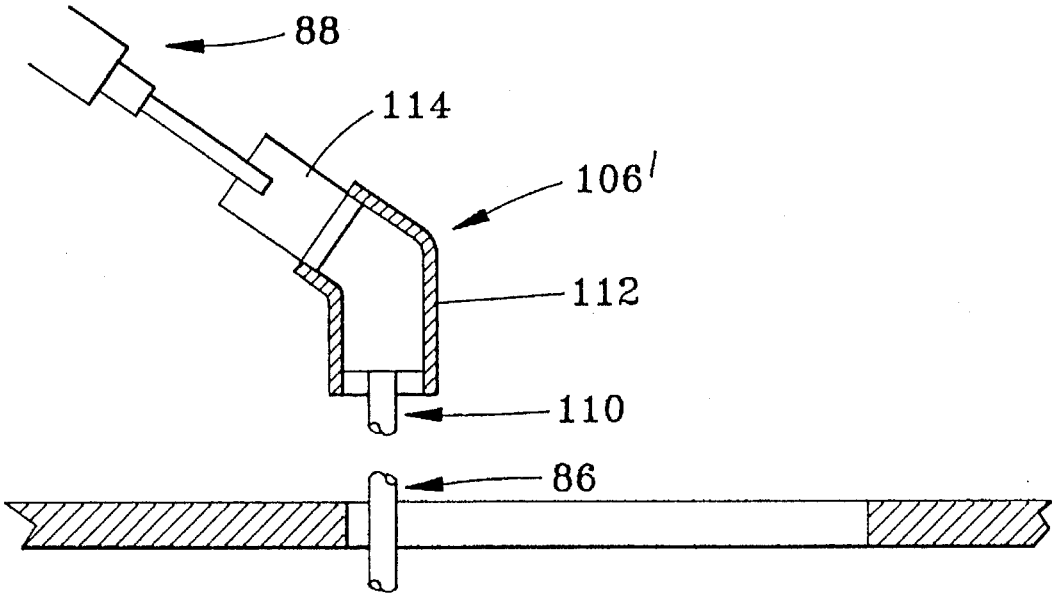
FIG. 5 illustrates another flexible coupling for attaching a wand to an antenna using a flexible tube.

FIG. 5 illustrates an alternative flexible coupling 106' where an elastic tube 112 serves as the flexible coupling 106'. When an elastic tube 112 is employed, an antenna extender 114 is provided which attaches to the antenna 88 and has a cross section similar to that of the wand 86. The elastic tube is attached to both the antenna extender 114 and the second end 110 of the wand 86 as is shown in FIG. 5.

When multiple microphone units are employed, it is preferred to have all units controlled by a common activation means which provide for extension of the wands with the rotation automatically activated for all antennas that are fully extended.

Figure 6:
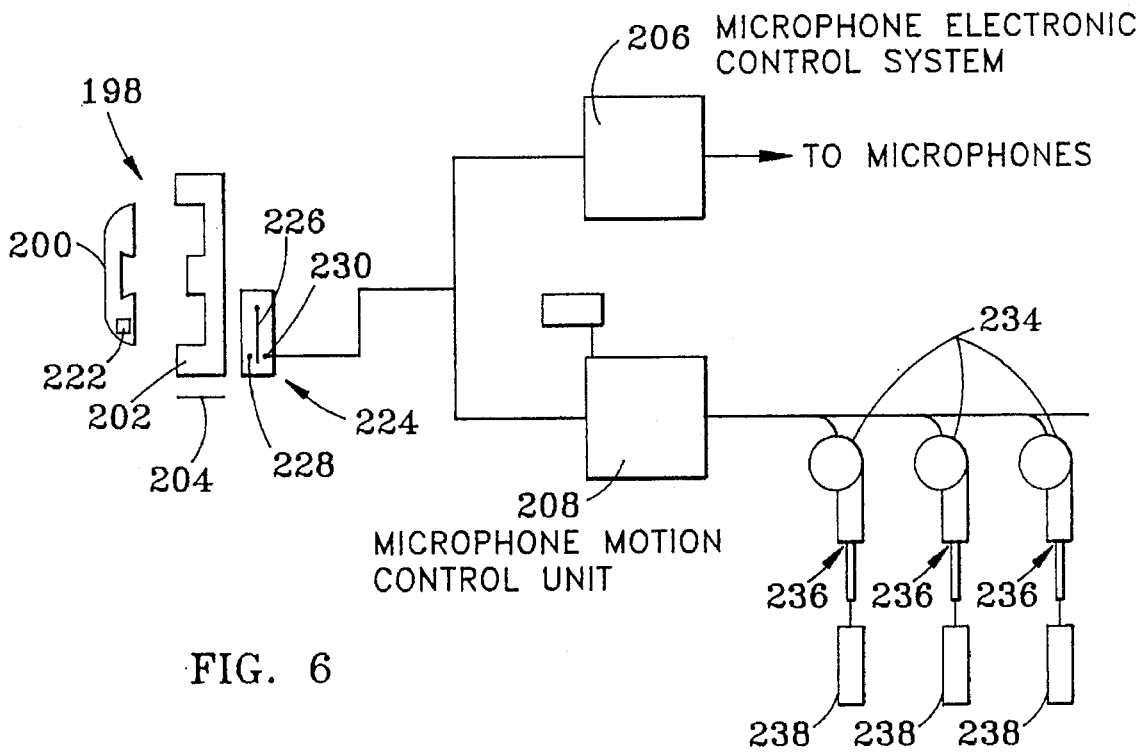
FIG. 6 is a schematic representation of the use of a phone to control a conference system to raise and lower the microphone units.

This can be conveniently accomplished by a conference system activated by a phone 198, as is shown schematically in FIG. 6. In this system, when a hand piece 200 is removed from a cradle 202, the microphones of the multi-microphone system will be activated. At the same time, the wands will extend and be positioned for use. The phone 198 has a proximity sensor 204 which senses the proximity of the hand piece 200 with respect to the cradle 202 of the phone 198. The proximity sensor 204 turns on the power to the microphone electronic control system 206 and a microphone motion control unit 208.

The proximity sensor 204, shown in FIG. 6, has a magnet 222 positioned in the hand piece 200 and a reed relay 224 positioned in the cradle 202. The reed relay 224, responsive to the position of the magnet 222, and a switching reed 226 of the reed relay 224, moves between an opened position 228 and a closed position 230 as the hand piece 200 is withdrawn from the cradle 202. When the reed relay 224 is closed, power is provided to the microphone electronic control system 206 and to the microphone motion control unit 208 which activates a circuit that provides power to the antenna motors 234, extending the antennas 236 and lowering the wands 238. When the antennas 236 reach their full extension, the motor 232 is stopped either by a clutching mechanism or by a current sensor, as discussed earlier.

When the hand piece 200 is placed in the cradle 202, the switching reed 226 of the reed relay 224 opens and power to the microphone electronic control system 206 and the microphone motion control unit 208 is eliminated, closing a circuit that provides current to the antenna motors 232 which retracts the antennas 236. When the antennas are fully retracted, the motors are stopped either by a clutching mechanism or by a current sensor.

Figure 7:
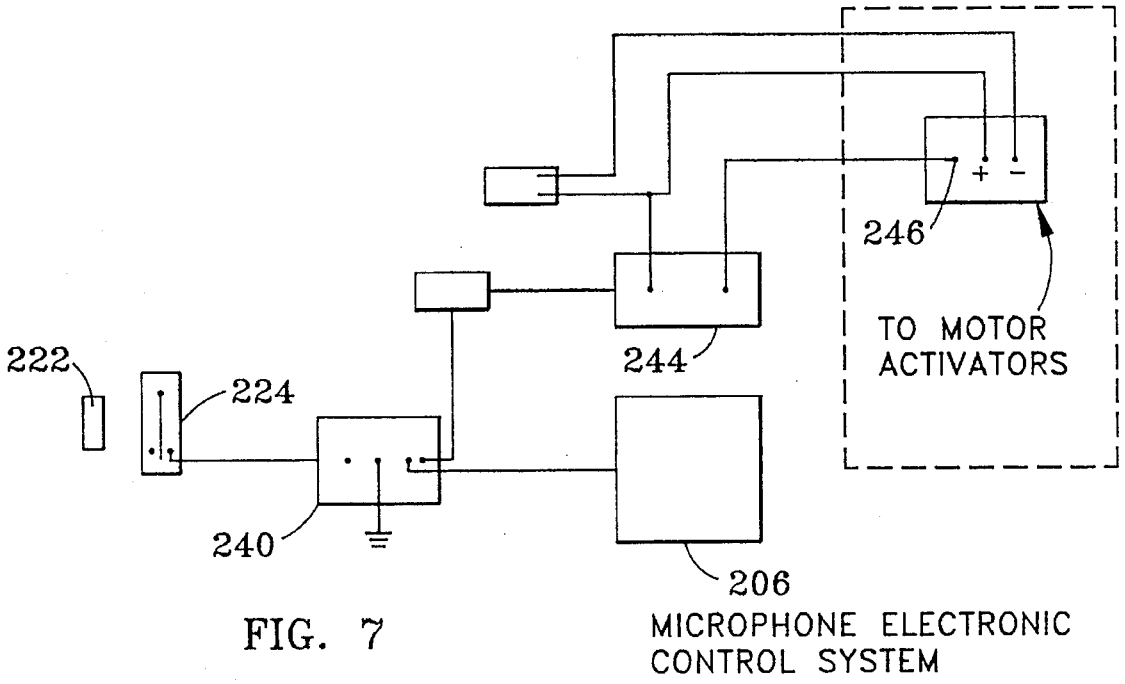
FIG. 7 is a more detailed schematic illustration of the system of FIG. 6 where a reed proximity switch activates a solid state relay which provides a power system.

A schematic view of a preferred control system of FIG. 6 is shown in FIG. 7. In this system, when the proximity sensor 204 closes, a solid state relay 240 closes and provides current to the electronic microphone controller 206 which controls the electronic balance of the microphone output. The current for the electronic microphone controller activates a 120 V AC relay 244, which trips a trigger 246 and provides 12 V DC power to the antenna motors 232 (shown in FIG. 6). Again, the antenna motors 232 extend the antennas 236 and, when full extension of the antennas 236 is reached, the motors 232 stop.

When the proximity sensor 204 is opened by placing the handset 200 in the cradle 202, the solid state relay 240 breaks the 120 V power, breaking the current to the controller mixer 242, and opening the 120 V AC relay 244, which in turn grounds trigger 246 and causes a reversal of the polarity motor 234, thereby retracting the antennas 236.

Figure 8:
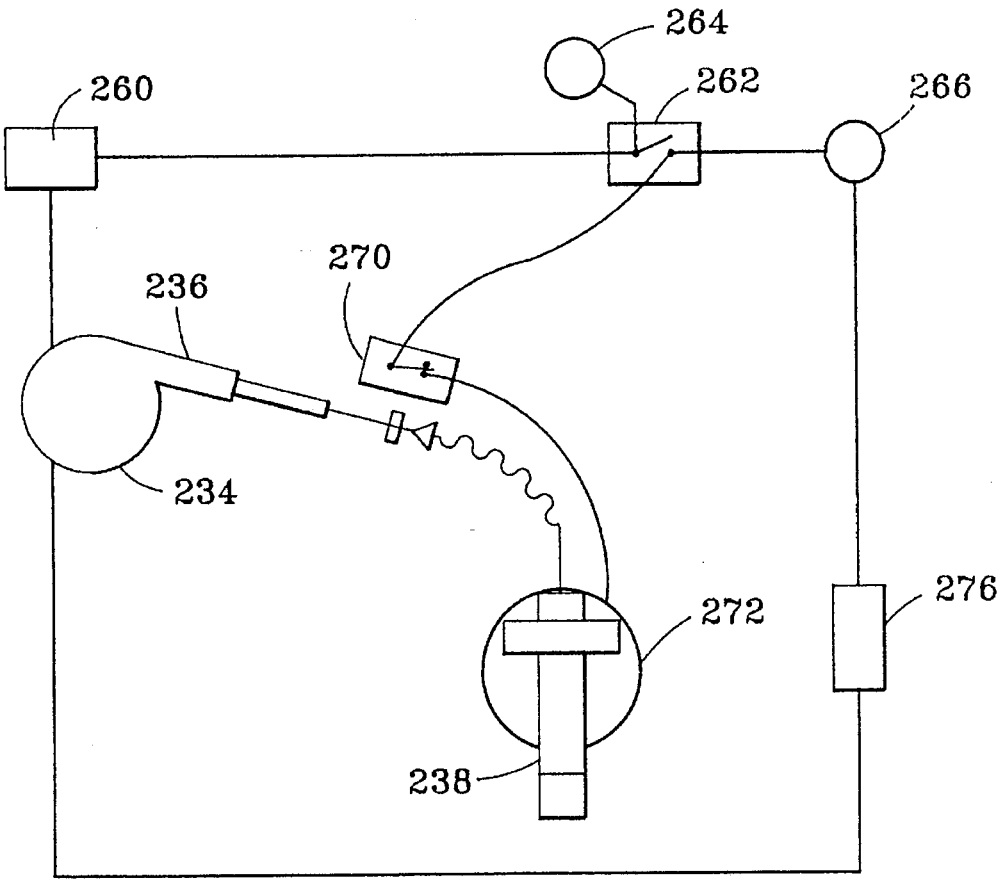
FIG. 8 schematically illustrates a control means to control the rotation and translation motions of the wands.

When the wands 238 of FIG. 6 are stored in tilted positions, additional controls are required to tilt the wands 238. To assure that the wands are not rotating before the antennas 236 have stopped and to further assure that only those wands which are fully extended are rotated, additional controls are provided. Failure to provide such can result in the system jamming. FIG. 8 illustrates a preferred rotation control system for the wands to assure that they are stationary before rotation and that only those wands that are fully extended will be rotated.

Preferably, motor current sensors 260 monitor currents being provided to the motors 232. When no current is sensed by the motor current sensors 260, a current sensor relay 262 is closed, providing power from a power supply 264 to a power terminal 266. The antennas 236 are provided with antenna proximity sensors 270 of the reed relay type which, when closed, allow current to flow between the terminal 266 and to servos 272. The antenna proximity sensors 270 are positioned such that their reeds will provide a closed circuit between the terminal 266 and the servos 272, when the wands 238 are fully extended. In this way, power is provided to activate the servos 272 that rotate the wands 238 from a tilted position to a vertical position. The wand rotation is stopped by a preprogrammed pulse-width driver and pacer circuit which control the rotation limits as well as the velocity of the rotation through the angle $\alpha$. Alternatively, a system comprised of magnetic proximity or micro switches may be used for positive location verification. In a larger, more elaborate installation, a controller utilizing digital switching gates and transistors can be employed as the means for monitoring and controlling microphone/wand extension, retraction, and rotation.

When the phone proximity sensor 204 for the phone 198 is opened by placing the hand piece 200 in the cradle 202, the solid state relay 240 breaks the 120 V power, opening the 120 V AC relay 244, which in turn grounds the trigger 246, thereby rotating the wands 238 to the storage angle $\alpha$ which is again controlled by predetermined limits in the drive circuitry of the servos. When the wands 238 have rotated up, they close a proximity switch 276 which provides current to the antenna motors 232 and the antennas 236 retract. When the antennas 236 are fully retracted, the power is turned off.

Figure 9:
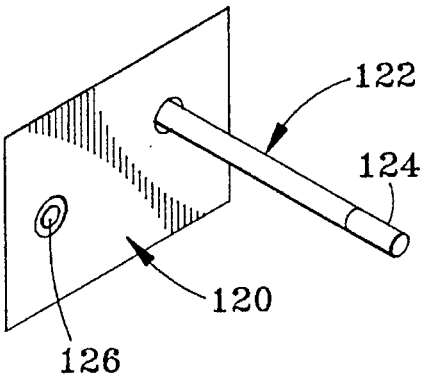
FIG. 9 illustrates a pair of microphones which store normal to the ceiling surface such as those of the embodiment of FIG. 1. A first microphone is shown in its retracted position while a second is shown in its extended position.

FIG. 9 shows an isometric view of two wands of the type illustrated in FIG. 1 which have been installed in a ceiling 120 section.

In FIG. 9, a first wand 122 is illustrated in its extended position with the first wand 122 extending beyond the ceiling 120. With the wand 122 so positioned, a microphone 124 mounted on the wand 122 is fully exposed and is positioned to provide a sound pick-up.

A second microphone 126 is shown which is being stored behind the ceiling 120.

Figure 10:
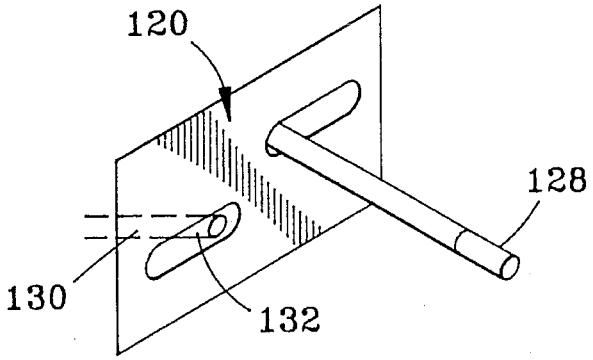
FIG. 10 illustrates two microphones which tilt before storing such as those of the embodiment of FIG. 3. A first microphone is shown in its retracted position while the second is shown in its extended position.

FIG. 10 shows an isometric view of two tilting wands of the embodiment of FIG. 3, installed in a ceiling section 120. A first wand 128 is shown in a rotated position while the second wand 130 is shown in a retracted position such that a microphone mounted thereon is positioned above the ceiling 120.

While the present invention has been described in terms of preferred embodiments, it should be understood that substitutions and changes may be made by one skilled in the art without departing from the spirit of the invention.

I claim:

1. A positionable microphone unit for ceiling mounting comprising:

guide mounted at or above the ceiling having a central passage;

means for securing said guide with respect to the ceiling;

a wand having a first end and a second end, said wand slidably engaging said central passage;

a microphone attached to said first end of said wand;

a microphone cord attached to said microphone passing through said wand exiting in the vicinity of said second end;

a power antenna or raising and lowering said wand, said power antenna having a telescoping antenna with a free end, said free end being attached to said second end of said wand; and a power antenna mount for attaching said power antenna above the ceiling.

2. The positionable microphone of claim 1 further comprising:

a positional stop adjustably attached to said power antenna.

3. The positionable microphone of claim 2 wherein said central passage of said tubular guide and said wand have acrylic surfaces.

* * * * *